US008863360B2

(12) United States Patent
Mukherjee et al.

(10) Patent No.: US 8,863,360 B2
(45) Date of Patent: Oct. 21, 2014

(54) LOCKABLE HINGE ASSEMBLY

(75) Inventors: Sudipto Mukherjee, New Delhi (IN); Anoop Chawla, New Delhi (IN)

(73) Assignee: Simpri Investments Limited, Hong Kong (HK)

( * ) Notice: Subject to any disclaimer, the term of this patent is extended or adjusted under 35 U.S.C. 154(b) by 372 days.

(21) Appl. No.: 12/780,847

(22) Filed: May 14, 2010

(65) Prior Publication Data

US 2011/0005033 A1 Jan. 13, 2011

(30) Foreign Application Priority Data

May 15, 2009 (IN) ..... 1000/DEL/2009

(51) Int. Cl.
*E05D 1/04* (2006.01)
*E05D 11/10* (2006.01)

(52) U.S. Cl.
CPC ..... *E05D 1/04* (2013.01); *E05D 11/1007* (2013.01)
USPC ..... 16/353; 16/355; 16/269

(58) Field of Classification Search
CPC ... E05D 11/1007; E05D 11/1078; E05D 1/00; E05D 1/04
USPC ..... 16/221, 319, 352, 350, 351, 355, 356, 16/362, 363, 365, 374, 375, 267, 268, 269, 16/353; 220/841; 292/137, 138, 145, 1, 292/DIG. 17
See application file for complete search history.

(56) References Cited

U.S. PATENT DOCUMENTS

| | | | | | |
|---|---|---|---|---|---|
| 485,613 | A | * | 11/1892 | Deane | 16/353 |
| 853,507 | A | * | 5/1907 | Fielding | 16/329 |
| 2,431,263 | A | * | 11/1947 | Lundgren | 4/236 |
| 3,744,085 | A | * | 7/1973 | Griego | 16/325 |
| 3,918,121 | A | * | 11/1975 | Williams | 16/319 |
| 5,329,667 | A | * | 7/1994 | Erskine | 16/269 |
| 5,809,617 | A | * | 9/1998 | Harris et al. | 16/273 |
| 7,243,406 | B1 | * | 7/2007 | Wray | 27/18 |
| 7,296,832 | B1 | * | 11/2007 | Campbell | 292/292 |

FOREIGN PATENT DOCUMENTS

GB 1315014 4/1973

OTHER PUBLICATIONS

Office Action dated Dec. 4, 2013 in Chinese Patent Application No. 201010173771.2.
Office Action dated Apr. 28, 2014 in Japanese Patent Application No. 2010-126251.

* cited by examiner

*Primary Examiner* — Jeffrey O Brien
(74) *Attorney, Agent, or Firm* — Baker & McKenzie LLP

(57) ABSTRACT

The present invention relates to a hinge joint mechanism. The hinge joint mechanism comprises a fixed component including a plurality of curved portions and at least one straight portion; a movable component including a plurality of curved portions and a plurality of straight portions; said hinge joint mechanism provides a relative rotation between the two surfaces of the hinge joints to rotate the movable component by a desired amount relative to the fixed component. The hinge joint mechanism of the invention provides a proper sealing in the joints to avoid liquid or any such kind of material to move across it.

8 Claims, 2 Drawing Sheets

LOCKABLE HINGE ASSEMBLY

TECHNICAL FIELD

The subject matter described herein in general relates to a lockable hinge assembly and in particular relates to a locking assembly for hinges.

BACKGROUND

Generally, hinges find numerous applications in different types of instruments, joints, containers, boxes etc. In certain cases, particularly in case of containers carrying cargo loads, sometimes it is desired that the lid of a container remains in open position loading or unloading the material from the container. Particularly, it is desired that the lid of a container stays in one or more positions. However, the chances of the lid of a container to stay in one or more positions are very uncertain because of the built-in technology of the container and the insufficient locking systems.

In other instances, where it is desirable for the hinge components to be in one or more interim positions to avoid any loss of the man, material and machinery, the locking of hinges becomes essential.

Conventionally, several types of locking systems have been developed in the art for hinges, each comprising different mechanisms. However, the locking systems used in the art are either complex or uneconomical and reliability of such conventional locking systems is also an issue. Further, due to the complex nature of the conventional locking systems, it becomes difficult to replace such systems for repairing etc. Furthermore, the conventional locking systems can be employed in a particular type of hinge and have to be modified for using in different type of hinge.

Thus, there is a need for a locking assembly for hinges that overcomes the above mentioned drawbacks.

SUMMARY

An object of the present subject matter is to provide a simple locking assembly for hinges.

Another object of the present subject matter is to provide a reliable locking assembly for hinges.

Yet another object of the present subject matter is to provide an economical locking assembly for hinges.

Yet another object of the present subject matter is to provide a locking assembly that can be employed in various types of hinges without any modification.

Accordingly, the subject matter relates to a lockable hinge assembly comprising a first hinge member, a second hinge member that is hingedly attached to the first hinge member, and a locking member. The locking member is provided at the attachment of the first hinge member and the second hinge member and is capable of sliding axially between the two members, wherein the insertion of the locking member ensures locking of the movement of the lockable hinge assembly. The locking member ensures that no liquids can be transported from one side of the lockable hinge assembly to the other, thereby ensuring the sealing of the contents on either side of the hinge.

In another aspect the subject matter relates to a transport container includes a lockable hinge assembly, said lockable hinge assembly comprising a first hinge member, a second hinge member that is hingedly attached to the first hinge member, and a locking member. The locking member is provided at the attachment of the first hinge member and the second hinge member and is capable of sliding axially between the two members, wherein the insertion of the locking member ensures locking of the movement of the lockable hinge assembly. The locking member ensures that no liquids can be transported from one side of the lockable hinge assembly to the other, thereby ensuring the sealing of the contents on either side of the hinge.

In one embodiment of the present subject matter, the lockable hinge assembly is a pinless hinge assembly.

In another embodiment of the present subject matter, the first hinge member is stationary and the second hinge member is movable.

In yet another embodiment of the present subject matter, the first hinge member is movable and the second hinge member is stationary.

In yet another embodiment of the present subject matter, both the first hinge member and the second hinge member are movable.

In yet another embodiment of the present subject matter, the locking member is a profiled in section consisting of multiple sections of constant curvature meshing with the fixed and moving parts.

In yet another embodiment of the present subject matter, at least one part of the locking member 103 meshes with the first hinge member.

In yet another embodiment of the present subject matter, the at least a part of the locking member 103 meshes with the second hinge member.

In yet another embodiment of the present subject matter, the locking member is rotated either manually or automatically.

BRIEF DESCRIPTION OF DRAWINGS

The features of this subject matter are set forth with particularly in the appended claims. The subject matter, together with its objects and advantages thereof may be best understood by reference to the following description taken in conjunction with the accompanying drawings, in which like reference numerals identify substantially like elements in the several figures and in which:

DETAILED DESCRIPTION

Figure 1:
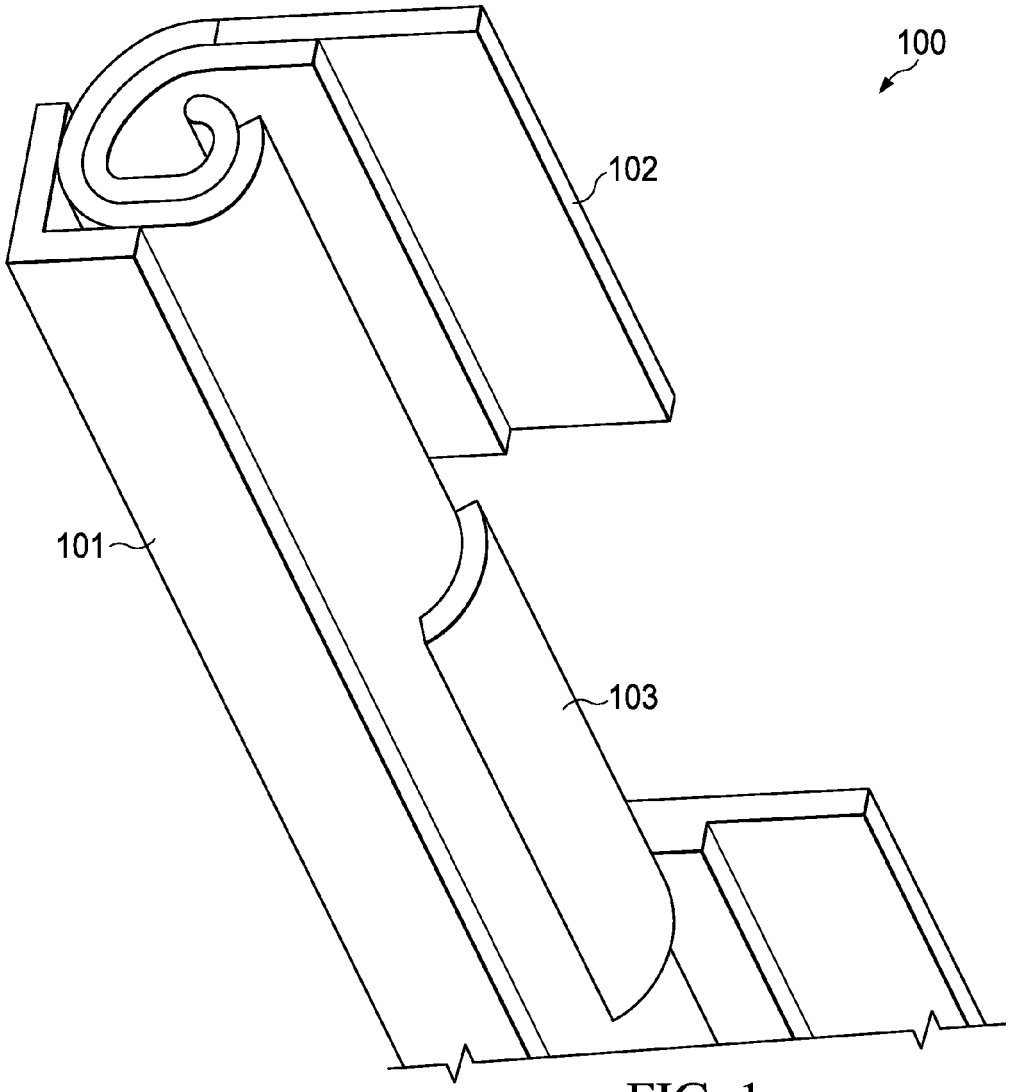
FIG. 1 illustrates a perspective view of a lockable hinge assembly in an unlocked position.

For the purpose of promoting an understanding of the principles of the subject matter, reference will now be made to the embodiment illustrated in the drawings and specific language will be used to describe the same. It will nevertheless be understood that no limitation of the scope of the subject matter is thereby intended, such alterations and further modifications in the illustrated subject matter, and such further applications of the principles of the subject matter as illustrated therein being contemplated as would normally occur to one skilled in the art to which the subject matter relates.

The lockable hinge assembly of the present subject matter provides a proper locking in the hinge joint in a position to avoid any relative motion between the two surfaces on which a hinge is fixed.

FIG. 1 illustrates a perspective view of a lockable hinge assembly 100 in an unlocked position. The lockable hinge assembly 100 includes two members, which are hingedly attached to each other. In particular, the lockable hinge assembly 100 comprises a first hinge member 101 and a second hinge member 102. In one preferred embodiment, the lockable hinge assembly 100 is a pinless assembly. However, the type of the lockable hinge assembly 100 may vary as is obvious to a person skilled in the art. Further, in different embodiments, the first hinge member 101 can be made stationary or the second hinge member 102 can be made stationary or both the first 101 and the second 102 hinge members can be made movable relative to each other. However, for the purpose of this description, in the present embodiment, the first hinge member 101 is made stationary and the second hinge member 102 is movable.

The relative motion of the first hinge member 101 and the second hinge member 102 can be blocked in open position with the help of a locking member 103. In one preferred embodiment, the locking member 103 is a profiled in section consisting of multiple sections of constant curvature meshing with the fixed and moving parts. However, in different embodiments, the shape and size of the locking member can vary as is obvious to a person skilled in the art. In the unlocked position, as shown in FIG. 1, at least a part of the locking member 103 meshes with the first hinge member 101 and does not block the rotation of the second hinge member 102. In an alternative embodiment, at least a part of the locking member 103 meshes with the second hinge member 102.

Figure 2:
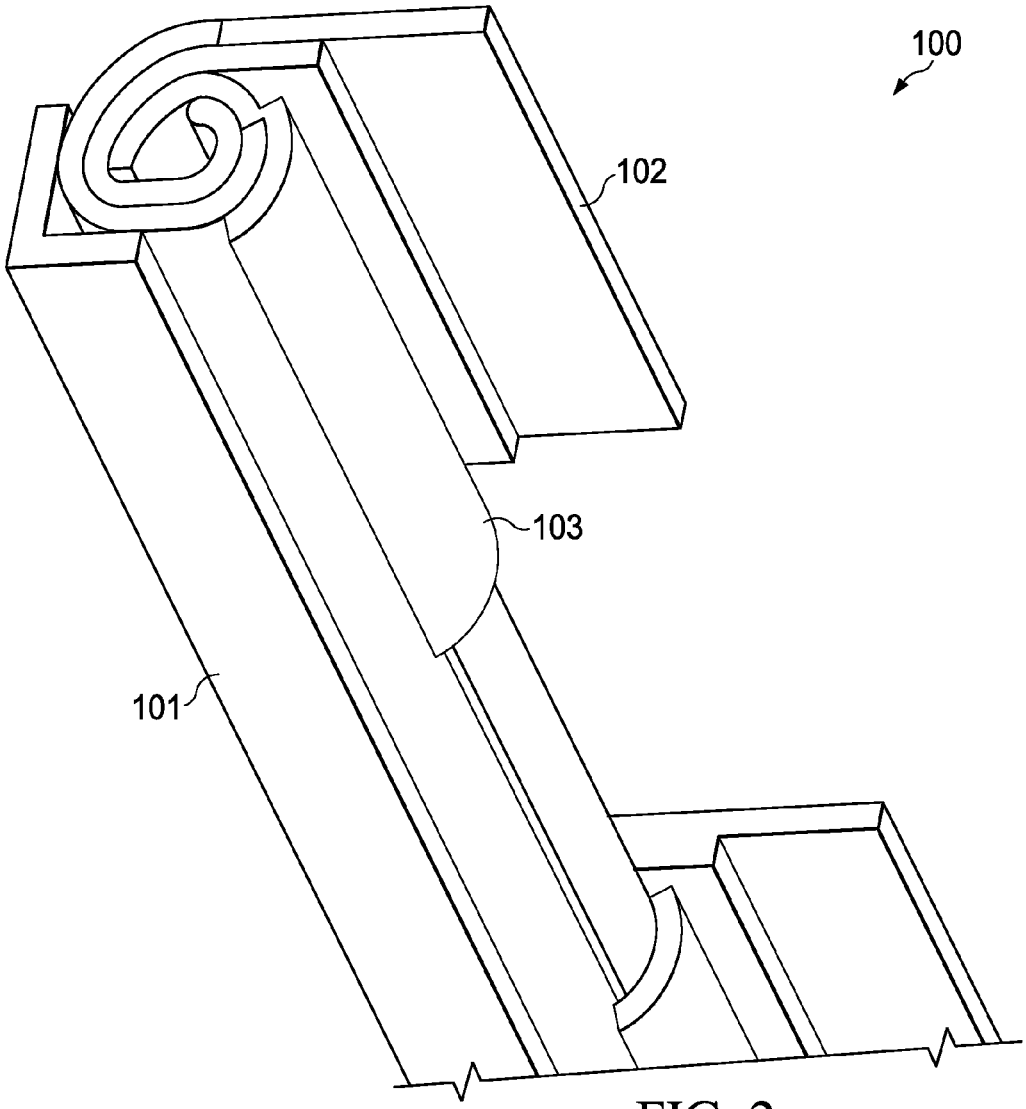
FIG. 2 illustrates a perspective view of a lockable hinge assembly in a locked position.

In order to lock the second hinge member 102 with respect to the first hinge member 101, the locking member 103 is moved axially in the locking position as shown in FIG. 2.

FIG. 2 illustrates a perspective view of a lockable hinge assembly in a locked position. As shown herein, the locking member 103 is slid axially in a position between the first hinge member 101 and the second hinge member 102, thereby restricting the movement of the second hinge member 102 with respect to the first hinge member 101. In different embodiments, the sliding of the locking member 103 can be done either manually or automatically.

Further, the aforementioned described locking mechanism for hinges is useful to stop rotation of surfaces on which the hinge is fixed by restricting motion at the hinge and an additional lock for such surfaces is not needed.

Further, the lockable hinge assembly of the present subject matter can be used in various appliances/equipment, particularly in transport containers.

In a specific embodiment the lockable hinge assembly of the present subject matter is used in a transport container.

The present subject matter is not to be limited in scope by the specific embodiments and examples which are intended as illustrations of a number of aspects of the subject matter and any embodiments which are functionally equivalent are within the scope of this subject matter. Those skilled in the art will know, or be able to ascertain using no more than routine experimentation, many equivalents to the specific embodiments of the subject matter described herein.

We claim:

1. A lockable hinge assembly comprising:

a first hinge member, the first hinge member comprising an outer convex surface;

a second hinge member hingedly attached to the first hinge member; and a locking member provided at an attachment of the first hinge member and the second hinge member, the locking member being capable of sliding axially between a locked position and an unlocked position between the first and second hinge members, wherein in the unlocked position, the locking member is in contact with at least one of the first and second hinge members;

wherein in the locked position, the locking member restricts a relative movement of the first hinge member and second hinge members, and wherein in the unlocked position, the first hinge member can move relative to the second hinge member;

wherein the locking member comprises a curved panel, the curved panel providing an inner concave surface and an outer convex surface, wherein the inner concave surface of the curved panel contours against the outer convex surface on the first hinge member; and wherein at least a portion of one of the first and second hinge members is partially enclosed within the other of the first and second hinge members.

2. The lockable hinge assembly as claimed in claim 1, wherein the first hinge member and second hinge member join together without the need for a separate interlocking pin.

3. The lockable hinge assembly as claimed in claim 1, wherein the first hinge member is stationary and the second hinge member is movable.

4. The lockable hinge assembly as claimed in claim 1, wherein the first hinge member is movable and the second hinge member is stationary.

5. The lockable hinge assembly as claimed in claim 1, wherein both the first hinge member and the second hinge member are movable.

6. The lockable hinge assembly as claimed in claim 1, wherein at least a part of the locking member meshes with the first hinge member.

7. The lockable hinge assembly as claimed in claim 1, wherein at least a part of the locking member meshes with the second hinge member.

8. The lockable hinge assembly as claimed in claim 1, wherein the locking member is slid either manually or automatically.

* * * * *

UNITED STATES PATENT AND TRADEMARK OFFICE

CERTIFICATE OF CORRECTION

PATENT NO. : 8,863,360 B2
APPLICATION NO. : 12/780847
DATED : October 21, 2014
INVENTOR(S) : Sudipto Mukherjee and Anoop Chawla It is certified that error appears in the above-identified patent and that said Letters Patent is hereby corrected as shown below:

On Title Page, Item (73), Assignees:

Please add the assignee -- Indian Institute of Technology, India (IN) -- so it reads as follows: "Assignee: Simpri Investments Limited, Hong Kong (HK); Indian Institute of Technology, India (IN)".

Signed and Sealed this
Ninth Day of August, 2016

Michelle K. Lee

Michelle K. Lee
*Director of the United States Patent and Trademark Office*